US008640418B2

(12) United States Patent
Paetrow et al.

(10) Patent No.: US 8,640,418 B2
(45) Date of Patent: Feb. 4, 2014

(54) SURFACE COVERING SYSTEM

(75) Inventors: Jörg Paetrow, Mannheim (DE); Mariusz Palgan, Ludwigshafen (DE)

(73) Assignee: Click'n Walk AG, Bern (CH)

( * ) Notice: Subject to any disclaimer, the term of this patent is extended or adjusted under 35 U.S.C. 154(b) by 0 days.

(21) Appl. No.: 13/056,253

(22) PCT Filed: Jul. 28, 2009

(86) PCT No.: PCT/CH2009/000265
§ 371 (c)(1),
(2), (4) Date: Mar. 30, 2011

(87) PCT Pub. No.: WO2010/012116
PCT Pub. Date: Feb. 4, 2010

(65) Prior Publication Data

US 2011/0179735 A1 Jul. 28, 2011

(30) Foreign Application Priority Data

Jul. 29, 2008 (DE) ..... 10 2008 035 414
Dec. 11, 2008 (DE) ..... 10 2008 061 612

(51) Int. Cl.
*E04B 2/00* (2006.01)

(52) U.S. Cl.
USPC ..... 52/582.1

(58) Field of Classification Search
USPC ..... 52/582.1, 578, 589.1, 590.2, 591.5
See application file for complete search history.

(56) References Cited

U.S. PATENT DOCUMENTS 6,647,689 B2 * 11/2003 Pletzer et al. ..... 52/592.1
6,769,835 B2 * 8/2004 Stridsman ..... 404/41
7,131,242 B2 * 11/2006 Martensson et al. ..... 52/591.3
7,647,740 B2 * 1/2010 Engstrom ..... 52/582.1
2004/0016197 A1 1/2004 Ruhdorfer
2004/0200175 A1 * 10/2004 Weber ..... 52/592.1
2005/0028474 A1 * 2/2005 Kim ..... 52/578
2005/0210810 A1 * 9/2005 Pervan ..... 52/578
2006/0154015 A1 * 7/2006 Miller et al. ..... 428/50
2006/0260249 A1 * 11/2006 Moriau et al. ..... 52/578
2007/0175156 A1 * 8/2007 Pervan et al. ..... 52/582.1
2007/0251188 A1 * 11/2007 Moriau et al. ..... 52/745.19
2008/0000183 A1 * 1/2008 Bergelin et al. ..... 52/480
2008/0010937 A1 * 1/2008 Pervan et al. ..... 52/588.1
2008/0172971 A1 * 7/2008 Pervan ..... 52/591.5
2008/0184646 A1 * 8/2008 Alford et al. ..... 52/582.1

FOREIGN PATENT DOCUMENTS

| | | |
|---|---|---|
| CH | 508792 | 6/1971 |
| DE | 19962812 | 6/2001 |
| DE | 10158215 | 8/2002 |
| DE | 10225579 | 12/2003 |
| EP | 1593795 | 11/2005 |
| WO | 03012224 | 2/2003 |
| WO | 03/040491 | 5/2003 |
| WO | 2006039726 | 4/2006 |

* cited by examiner

*Primary Examiner* — Mark Wendell
*Assistant Examiner* — Keith Minter
(74) *Attorney, Agent, or Firm* — Rankin, Hill & Clark LLP

(57) ABSTRACT

A surface covering system for covering surfaces with a covering material, particularly for covering wall surfaces or floor surfaces with tile material. The surface covering system includes at least two covering modules, which can be placed on the surface so as to adjoin each other. A first covering module has at least one first sealing profile, and a second covering profile has at least one second sealing profile. The sealing profiles are designed to engage each other in a positioned state of the covering modules and form a common seal.

17 Claims, 8 Drawing Sheets

SURFACE COVERING SYSTEM

BACKGROUND OF THE INVENTION

1. Field of the Invention

The invention relates to a surface covering system for covering surfaces with a covering material and to a covering module and a frame for use in this type of surface covering system. These types of surface covering systems, covering modules and frames are used to cover almost any surface, for example wall surfaces, floor surfaces, ornate surfaces or the like, in particular in the area of construction engineering. In principle, however, other applications are also possible.

2. Description of Related Art

Numerous surface covering systems, designed according to different criteria, are known, in particular in the area of construction engineering. These types of surface covering systems, as are also proposed within the framework of the present invention, are used, for example, to cover wall surfaces, floor surfaces or ceiling surfaces with a covering material. This covering material can include different materials, for example metal materials, ceramic materials, timber, glass, plastic materials or similar materials commonly used for covering systems or combinations of the named and/or other materials.

When covering surfaces, for example level, angled or curved surfaces, attention has to be paid to different criteria. An essential criterion in many cases is that the positioning process has to be effected simply and rapidly. The surface covering systems, in this case, are usually either simply placed onto the surface to be covered or are connected to said surface to be covered. Therein the latter can be effected, for example, by means of a positively-bonded connection, in particular by means of tile adhesive or similar types of positively-bonded connections. As an alternative or in addition to this, mechanical securing elements can also be used, for example for a non-positive locking connection and/or a positive locking connection, for example hooks, screws or the like.

Surface covering systems that are composed of individual modules are known in the prior art. These individual modules can be mechanically interconnected via connecting systems, for example in the form of so-called click connections. Examples of these types of click connections, which can operate, for example, in accordance with the tongue and groove principle, are disclosed in DE 101 58 215 A1. A laying system for tiles is described therein, in particular for stone tiles, for creating a ceiling, wall or floor covering, wherein the tiles are provided with a supporting frame on which at least a part of the tile surface area rests. Each of two adjacent sections, the supporting frames contain an attachment designed to accommodate a rubber-elastic sealing profile that defines the joint width.

However, apart from the mechanical demands made on these types of surface covering systems, in many cases further demands are made. In particular, these are demands made with reference to compatibility with liquid media, such as, for example, water or cleaning agents. Thus, many surface covering systems are used in the area of wet rooms, baths, toilets, kitchens or living areas in which they have frequent contact with water or other liquids.

An essential criterion of these types of surface covering systems, consequently, in many cases is a suitable seal between the individual modules of the surface covering system. In the case of conventional systems in which the modules are bonded to the surface to be covered, a jointing compound or grout is consequently used as a rule between the individual modules, in particular between individual tiles, and this prevents moisture from being able to pass through the crevices between adjacent modules behind the module, in particular onto the surface to be covered.

Seals are consequently provided on the individual modules in the case of the named surface covering systems that are simple and rapid to place, in particular in accordance with the click principle. The sealing profiles described in DE 101 58 215 A1 are an example. Another example of these types of sealing profiles is known from CH 508 792. This describes a method for sealing joints between structural elements, in particular between concrete slabs. These types of structural elements are to replace the conventional method of grouting using a filler and are based on the fact that adjacent structural elements in each case comprise a seal, said seals being pressed against each other when the structural elements are placed.

However, in practice these known devices and methods have a multitude of disadvantages, which are not tolerable in every case and which sometimes lead to unsatisfactory results in the surface covering. Thus, for example, in the method described in DE 101 58 215 A1, in many cases a gap forms between the sealing profile of one module and the body of the other module. This is caused, in particular, by the fact that in many cases the panels are subject to production tolerances, in particular natural pieces such as, for example, timber boards, stone tiles or similar natural materials. A change in the dimension of the pieces over the period of use, for example by absorbing moisture or the timber "moving", can also lead to these types of gaps being formed. However, the effect of said gaps is that moisture is able to pass between the sealing profile and the piece to the supporting frame lying underneath and/or to the surface to be covered lying underneath.

A similar problem is also presented with systems like the system described in CH 508 792, where two seals of adjacent modules are pressed onto each other. As the seals rest directly on the slab materials of the structural elements, which in their turn, however, can be subject to the above-mentioned production tolerances, for example, the pressure at which the seals are pressed onto each other, and consequently the sealing effect of the system or of the method is also subject to the named fluctuations, even though two-part sealing systems, like the sealing system described in CH 508 792, as a rule have a higher level of sealing than, for example, the sealing system described in DE 101 58 215 A1.

Another disadvantage of known two-part sealing systems, such as, for example, the sealing system described in CH 508 792, is of both an esthetic and a technical nature. Thus, these seals are realized in such a manner that between the individual seals pressed against each other, there is an edge that as a rule is clearly visible. The seals are in many cases curved around said edge, all in all non-uniformity being generated in the course of the top surface of the two-part seal realized in common at the edge caused by the pressure that is necessary for the seal. This non-uniformity is not only undesirable esthetically, but could even result in leakages in the region of said edge on account of the curvature and of the stresses occurring at that location, in particular if the sealing material becomes increasingly brittle due to age.

Thus, it is the object of the invention to provide a surface covering system, which avoids the above-described disadvantages of known surface covering systems at least extensively. In particular, the surface covering system should be constructed in a modular manner and at the same time provide a seal that is aesthetically pleasing yet technically improved.

BRIEF SUMMARY OF THE INVENTION

This object is achieved through a surface covering system and through a covering module and a frame, in each case for use in a surface covering system as claimed in the invention. Advantageous further embodiments of the invention, which are realizable individually or also in combination, are represented in the dependent claims.

The surface covering system is used for the complete or partial covering of surfaces with a covering material. In this case reference can be made extensively to the above-described possibilities for the design of these types of surface covering systems. In particular, it is possible to cover level, curved or angled surfaces. For example, floor surfaces and/or wall surfaces and/or ceiling surfaces in a building can be covered in this manner with the covering material. The covering can therein be used for aesthetic purposes and/or can be of a functional nature, the latter for example for protecting the surface to be covered from liquids, gases, contaminants or similar attacks. In principle, the surface to be covered does not have to be of a totally closed nature; at least partially cantilevered surface covering systems, for example, can be produced.

The term covering material, in this case, can refer to an arbitrary material that forms the predominant component of the top surface of the surface covering system that is visible after the covering process. Thus, for example, a top surface of said covering material can form at least 50% of the overall perceptible outside surface of the surface covering system. In this case, the above-mentioned materials, which can have, for example, a top surface that is smooth, level, roughened, painted or glazed, curved, formed in the manner of a relief or designed in any other manner and faces outwards, can be named as typical examples of these types of covering materials. The covering materials, in this case, can also be designed so as to be at least partially transparent or translucent or also non-transparent, for example by using transparent or translucent glass materials, plastic materials, crystal materials or ceramic materials. As an alternative or in addition to this, reflective covering materials, for example, can also be used. Typical covering materials that can be used within the framework of the invention are natural materials, such as, for example, stone, clay, ceramic, timber or similar natural materials. As an alternative or in addition to this, artificial materials can also be used, for example, ceramics, glass, plastic materials, concrete materials or the like. Combinations of the named materials and/or other materials are also conceivable.

In this case, as detailed above, the surface covering system is constructible in a modular manner and comprises at least two covering modules. Said covering modules include the covering material, for example tile material. For example, this type of covering material can be in the form of panels, for example rectangular, round or polygonal panels, into which the covering modules are introduced, for example (as explained below in more detail) into a frame of said covering modules. The individual covering modules and/or the finished surface covering system, in this case, can be connected temporarily or permanently to the surface to be covered and/or can simply be placed on said surface to be covered. The former can, for example, be effected by means of the above-described positive-bonding, non-positive locking or positive locking connection techniques or combinations of said connection techniques. The latter can be used, for example, in the area of coverings that are simply to be used temporarily, for example in order to decorate or protect a room surface temporarily with parquet flooring or with a surface covering system similar to parquet flooring. Various other possibilities are conceivable.

In order to ensure this modular construction, the covering modules, which are also claimed as individual parts within the framework of the present invention, are to be placeable in an adjoining manner on the surface to be covered. The term "adjoining" in this case refers to the fact that said covering modules can enter into contact along at least one abutting edge. The term abutting edge in this case generally refers to an outer boundary region or a boundary line that defines a covering module and/or a covering material towards the outside, for example towards an adjacent covering module. In this case, in the positioned state the individual covering modules can simply adjoin each other loosely without a tighter mechanical connection being provided. However, as an alternative to this, the covering modules can also, as explained in more detail below, be mechanically interconnected by means of corresponding connecting elements.

The covering modules, in this case, are shaped in such a manner that a first covering module comprises a first sealing profile, in particular on a first abutting edge. A second of the covering modules comprises a second sealing profile, in particularly on a second abutting edge. The term sealing profile, in this case, refers generally to an element that, on its own or in cooperation with other elements, in particular sealing elements, comprises a sealing effect. Said sealing effect is to prevent in particular a penetrating of fluid media, in particular liquids, into an intermediate space between adjacent covering modules. Said sealing effect is to delay this penetration in an at least considerable manner even if, as a rule, it is not possible to prevent slow penetration absolutely. For this purpose, it is especially preferred if the sealing profiles are designed so as to be at least deformable, preferably even elastically deformable. Different embodiments of these types of elastic or deformable materials are mentioned in the above-described prior art and/or shall be explained in more detail below.

In this case, the sealing profiles of the adjacent covering modules are to interact in a complementary manner. For this purpose, the sealing profiles should be designed in such a manner that they can interlock during the positioning process. The term interlock, in this case, refers to an operation where in the positioned state at least one region of a sealing profile associated with a covering module is further away from the covering material of said covering module than a region of a sealing profile of another covering module. In other words, the sealing profiles of adjacent covering modules, in top view onto a plane perpendicular to the surface covering system, are to be designed overlapping at least in a regional manner. This can be realized, for example, as a simple overlap. As an alternative or in addition to this, the sealing profiles, as explained in more detail below, can also be hooked into each other or can enter into a connection in another way that is mechanically more robust than is the case with a simple overlap.

The two sealing profiles therefore form a common seal when interlocking. The term common seal, in this case, in contrast to directly adjoining individual sealing profiles as described in CH 508 792, refers to a seal that does not include a straight constant gap between the adjoining covering modules. In particular, no level gap surface is to be formed, such as, for example, in the arrangement described in CH 508 792.

This design as proposed according to the invention brings about a greatly increased sealing effect for the finished surface covering system. The interlocking of the adjacent sealing profiles makes, in particular, the penetration of moisture much more difficult. In addition, as explained below in more detail by way of examples, the interlocking of the sealing profiles can also be used to increase the mechanical stability of the connection between adjacent covering modules.

The surface covering system can be further designed in an advantageous manner in many ways. Thus, a first advantageous aspect of the invention is of both an aesthetic and a technical nature. In the case of said design of the surface covering system as claimed in the invention, the common seal is shaped in such a manner that said seal comprises a substantially seamless top surface. Therein the term substantially seamless top surface refers to a top surface that to an observer is composed of two or more individual part surfaces. This can be effected, in particular, in that the seamless top surface is formed substantially either by the first sealing profile or by the second sealing profile. Thus, for example, the first sealing profile can completely overlap the second sealing profile, or vice versa, such that an observer, with the surface covering system in the positioned state, perceives only one common sealing material in the joints between the individual covering materials, for example tiles, namely that of the first sealing profile or of the second sealing profile.

In this way, a substantially complete overlap (it being possible for overlaps of at least 95% to still be tolerable within the framework of the aspect of the invention) can result in an increased sealing effect. The omission of the joint between adjacent seals, as is clearly recognizable in CH 508 792, results in avoiding the above-described disadvantages of a leak at said joint. Only the joints between the covering materials and the associated sealing profiles remain, it being possible to minimize said joints structurally, however, within the framework of the production of the individual covering modules. In contrast, for example, to DE 101 58 215 A1, where a substantially seamless sealing top surface between the individual covering materials is also perceptible to the observer, and this common seal is always composed of two individual parts, namely the two complementary sealing profiles, which improves the mechanical sealing effect.

A further advantageous design of the invention relates to the type of interlocking between the individual sealing profiles. As represented above, said interlocking can include, for example, an overlapping of the elements of the complementary sealing profile. As an alternative to this or in addition, one of the two sealing profiles can also be shaped as a male sealing profile, that is to say as a sealing profile with at least one projection. For example, said projection can be a projection with a rounded and/or polygonal profile and/or a hook profile, for example a hook profile with at least one undercut. The respective other of said sealing profiles preferably includes a female sealing profile. The term female sealing profile refers correspondingly to an indentation, into which the male sealing profile is able to engage in a complementary manner. This engagement can be effected without force and can be simply reversible or alternatively can also be connected to a hook or lock, which at least makes a new separation of the sealing profiles difficult. The design of the sealing profiles in the form of male and female sealing profiles increases the sealing effect in an additional manner. In this case, the sealing profiles can also be designed just partially as male and female. Thus, for example, a hermaphrodite design is also possible in which each sealing profile is designed in part in a male manner and in part in a female manner, which can further improve the engagement in adjacent sealing profiles. However, as always, a complementary design of said two sealing profiles is to be ensured.

Analogously to the devices described in DE 101 58 215 A1, for example, the surface covering system according to the invention can also be provided advantageously with a frame. Thus, the covering modules can each have at least one frame, the covering material being mounted on the frame. Said frame, for example a laying frame, can be produced from a conventional material ensuring mechanical stability. Thus, for example, plastic frames, timber frames, ceramic frames, metal frames (for example steel frames) or similar materials or material combinations can be used.

The frame can provide the mechanical support function and in particular can have one or more supporting surfaces, which can rest on the surface to be covered. For example, said supporting surfaces can be designed in the shape of feet or support pads, which sit on the surface to be covered. Depending on the type of connection between the covering modules and the surface to be covered, said frames can also provide the corresponding connecting elements. In the case of a positively-bonded connection, these can be, for example, adhesive surfaces. In the case of positive locking and/or non-positive locking connections, corresponding mechanical elements can be provided on the frames and these can be used to connect to the surface to be covered. Different designs are possible.

The frame is to be shaped to accommodate the covering material. This can be effected, for example, in that the frame comprises a corresponding accommodating means for the covering material, for example an accommodating means that essentially corresponds to the covering material in its dimensions. In the case of panel-shaped covering materials, this can be effected, for example, in the form of indentations, protruding edges, locking lugs, gripping devices or similar types of accommodating elements and/or in the form of simple supporting surfaces on which the covering material can rest. The connection between the covering material and the frame can be effected once again in an arbitrary manner, for example by means of a positive locking and/or non-positive locking and/or adhesive connection. Thus, for example, the covering material can be bonded to the frame, wherein for example, the gaps between the frame and the covering material are sealed simultaneously. However, in principle, other types of securing are also possible, for example clamping, screwing or similar types.

In the case where frames are provided, the sealing profiles can in principle be connected, for example, to the covering material. It is however particularly preferable if the sealing profiles are at least partially connected to the frame or are shaped in one piece with the frame. Realizing the sealing profiles in one piece with the frame can be effected, for example, by means of a multiple-component production process, by means of which, for example, it is possible to use different materials for the sealing profiles and for the frame. Multiple-component injection molding, multiple-component transfer molding or similar shaping methods that enable individual components of one and the same workpiece to be produced from different materials can be named as examples.

In the case where the sealing profiles are connected to the frame, it is especially preferred to bind them by means of an adhesive and/or non-positive locking connection. Glue can be named, for example, as an example of an adhesive connection. As an alternative or in addition to this, the above-described multiple-component forming methods can be viewed in certain respects as adhesive bonding methods. As an alternative or in addition to this, non-positive locking connections can be used, for example non-positive locking connections by means of pressing. Thus, for example, the sealing profile can be pressed onto a connecting region of the frame. Said connecting region can, for example, be corrugated or roughened or can comprise corresponding hook elements or other elements that engage in the sealing profile during the pressing process and further improve the grouting and its mechanical resilience.

As represented above, the sealing profiles can also be shaped in one piece with the frame. For example, the sealing profiles and the frame can be produced in the same forming process. For example, a plastic material can be cast or injected into a mold, which comprises mold cavity components for the frame and for the sealing profiles. The plastic material can then be hardened in said mold, for example by means of simple cooling and/or by means of a curing process. Polyurethane and/or silicone, in particular, can be named as examples of materials for shaping frame and sealing profile in one piece in this manner. In general, for example, thermosetting and/or elastomer plastic materials can be used; however, in principle, thermoplastic materials can also be used. Combinations of plastic materials and/or other materials are possible, for example filled plastic materials can be used.

A further advantageous aspect of the invention relates to the interconnection between the individual covering modules. As represented above, adjacent covering modules can, for example, just be loosely placed adjoining each other. It is especially preferred, however, if the covering modules are also additionally mechanically interconnected, such that separation of the covering modules is at least made difficult. In this way too, the complementary sealing profiles can be pressed against each other, that is to say can each be impinged upon by a force such that a permanent sealing effect is improved.

For this purpose, the covering modules can comprise mechanical connecting elements, which are set up to enter into a mechanical connection when the covering modules are placed. In particular, this can be a non-positive and/or positive locking connection.

Therein the mechanical connecting elements can once again be realized, in principle, on arbitrary elements of the covering modules. Thus, they can for example, be shaped on the covering materials. However, it is especially preferred if the mechanical connecting elements are realized at least in part on the above-represented optional frame of the covering modules, for example similar to the structure described in DE 101 58 215 A1. The mechanical resilience is consequently preferably left entirely to the frame, whereas the covering materials, which are often brittle and can only be worked with difficulty, can simply be accommodated in the frame and contribute nothing or very little to the actual connection.

The mechanical connecting elements therein can be realized in principle in different ways. Thus, for example, the mechanical connecting elements can comprise plug-in elements, tongue and groove elements, hook connections, click laminate connectors or combinations of the named and/or of other connecting elements. The term click laminate connector refers, in this case, to locking connections that bring about a locking of complementary mechanical connecting elements of adjacent covering modules and as are known, for example, from the area of parquet technology and/or in DE 101 58 215 A1. In general, the effect of the described advantageous design with the mechanical connecting elements is that the surface covering system can be put together rapidly and simply without the individual covering modules having to be fixed mechanically in an expensive and time-consuming manner.

The mechanical connection between the covering modules by means of the connecting elements can be effected in particular in such a manner that in the connected state, the covering modules are held together in such a manner that a force that increases the sealing effect and deforms the sealing profiles individually or both together is exerted on said sealing profiles. The connecting elements or the mechanical connection formed by said connecting elements can be shaped in such a manner that when two covering modules are joined together in a non-level orientation of the covering modules to each other, it is possible to join the mechanical connecting elements together in a substantially force-free manner. In a level orientation of the covering modules to each other, in contrast, a force can be exerted onto at least one of the sealing profiles, in particular by means of the respective other sealing profile, which means that the sealing profile impinged upon by the force is mechanically deformed.

In other words, the joining together of the covering modules in an orientation of the covering modules in which said modules are not aligned level with each other can be formed in such a manner that the sealing profiles essentially do not become deformed. In a level orientation of the covering modules to each other, which can be produced, for example, by means of the dead weight of the covering modules and/or by means of an external force, a deformation of the sealing profiles can then be effected, for example by means of a corresponding shape of the connecting elements, by means of which deformation, for example, the sealing profiles of the joined covering modules are pressed and/or deformed against each other, thereby in particular being able to increase the sealing effect. For example, the connecting elements can comprise an interacting male connecting element and a female connecting element. In the abovementioned, non-level orientation, for example, these are able to fit together comfortably, essentially without any deforming forces being exerted. In a level orientation, in contrast, this fit can be lifted, for example by, in said orientation, the male connecting element being pulled or pushed into a position in which the female connecting element is deformed by the male connecting element. Different shapments are possible and examples are described below.

The sealing profiles can be designed in particular so as to be deformable. The connecting elements and/or the sealing profiles can comprise at least one relief space. Said at least one relief space can be designed to absorb any deformation occurring when two covering modules are joined together, for example the above-described deformation that occurs when a level orientation is produced. Said relief space can be arranged, for example, inside the sealing profiles and/or also between the sealing profiles. For example, the at least one relief space can include at least one relief gap, for example a relief gap that is arranged in a surface pointing to the respective other sealing profile. In general, the at least one relief space can include free spaces into which elements of the sealing profile can yield even in the joined state of the covering modules, if said modules are deformed. Examples are described below.

Another preferred embodiment of the invention relates to the materials that can be used for the sealing profiles. The sealing profiles are preferably designed so as to be completely or partially plastically and/or elastically deformable. In particular, it is preferred if the sealing profiles comprise at least one of the following materials: a foamed material, in particular a polyurethane foam; an elastomer material, in particular a silicone and/or a rubber material; a plastically deformable material, for example a plastically deformable thermoplastic material; an elastically deformable material; a material that is at least partially transparent to visible light. Combinations of the named materials or material features are conceivable. By using at least partially transparent materials, translucent materials also being able to be included, particular light effects can be achieved, which can be of particular aesthetic charm in different areas of decorative wall coverings.

Another preferred embodiment of the surface covering system, which also affects the embodiment of the covering modules as claimed in the invention, is in the arrangement of the sealing profiles. Thus, as represented above, with the surface covering system according to the invention, a first sealing profile is provided on a first covering module and a second sealing profile on a second covering module. In this case, however, the individual covering modules do not necessarily have to be shaped differently. In particular, a single covering module can comprise both at least one first sealing profile and at least one second sealing profile. For example, each covering module can comprise two first sealing profiles and/or two second sealing profiles. Thus, for example, the first sealing profiles or the second sealing profiles can be arranged in each case on opposite abutting edges of the covering modules. As an alternative to this and especially preferred within the framework of the present invention, however, is an embodiment where the first sealing profiles are in each case arranged crosswise, that is to say on adjoining abutting edges, for example on abutting edges that extend at a right angle to each other. As an alternative to this or in addition, the two second sealing profiles can be arranged on adjoining abutting edges, for example once again on abutting edges that extend perpendicular to each other. As is described in more detail below by way of the exemplary embodiments, a seamless, large-area surface covering can be created in this way in a particularly simple manner without interrupting the seal.

As represented above, the two sealing profiles are shaped in a complementary manner to each other. A preferred embodiment of the invention relates to this complementary design. Thus, for example, a first of the two sealing profiles can comprise an accommodating part with a first supporting surface, whereas the other of the two sealing profiles comprises an overlap part with a second supporting surface. For example, one of the two supporting surfaces can point towards the top surface of the covered surface and the respective other supporting surface in the opposite direction. However, other embodiments are also possible. In particular, the supporting surfaces ought to comprise a vectorial surface component parallel to the surface to be covered. In the laid state, in this case, the overlap part is to overlap the accommodating part at least partially. In this case, the second supporting surface rests at least partially on the first supporting surface. It is especially preferred if, in this case, during the laying process the overlap part is pressed down against the accommodating part. For this purpose, the overlap part can be shaped in such a manner that said overlap part is pressed away by the accommodating part during the laying process, such that a resetting force is realized pressing the overlap part against the accommodating part. As an alternative to this, or in addition, a lifting element can also be provided, said lifting element, during the laying of the surface covering system, causing the overlap part to be pressed against the accommodating part. Said pressing of the accommodating part against the overlap part or vice versa has the general effect of increasing the sealing effect of the common seal.

The interaction between overlap part and accommodating part can also be combined with an interlocking action between overlap part and accommodating part. Thus, for example, the overlap part can comprise a projection, for example a projection pointing to the accommodating part, the accommodating part comprising a groove that points to the overlap part. The projection and the groove, in this case, are shaped in such a manner that when the two covering modules are connected, the projection engages in the groove.

The supporting surfaces of the overlap part or of the accommodating part can be shaped in different ways. Thus, for example, they can be shaped as inclined supporting surfaces, that is to say as supporting surfaces that extend at an angle differing from 0° (for example 45°) to the surface of the surface covering. Said inclined supporting surfaces can be shaped, for example, as level supporting surfaces. As an alternative to this or in addition, the supporting surfaces can also be formed completely or in part as round or rounded supporting surfaces, for example with radii of curvature that correspond to each other. This can also additionally increase the sealing effect.

It has been described above that in a preferred embodiment, the covering modules can interlock in each other by means of mechanical connecting elements, for example in the form of male and female connecting elements. In an analogous manner, as an alternative to this or in addition, this type of interlocking can also be effected via the sealing profiles. Thus, for example, one of the two sealing profiles can comprise a male interlocking element, that is to say an interlocking element with a projection, whereas the other of the two sealing profiles comprises a female interlocking element, that is to say an interlocking element with a corresponding indentation into which the male interlocking element can engage. In this case, the interlocking elements can be set up to interlock into each other during the laying process and to strengthen a sealing effect of the common seal. For example, once again corresponding grooves and tongues can be provided in the sealing profiles. In general, the interlocking elements, as well as achieving a sealing effect, can also be set up to increase the mechanical stability of the common seal, for example by said interlocking elements locking or hooking into each other.

As represented above, the covering modules can each be shaped with at least one first sealing profile and with at least one second sealing profile. It is especially preferred if all of the covering modules are shaped substantially identically. This can greatly simplify storage as only one type of covering module has to be stocked, possibly including any different covering materials. For example, this sameness of the covering modules and/or of the frames of said covering modules can be achieved in that they comprise in each case at least one first sealing profile and at least one second sealing profile at the corresponding positions, for example, as detailed above, on adjacent abutting edges. Other designs are also possible. Different examples of these types of designs are explained in more detail below.

As stated above, along with the surface covering system with several modules, a single covering module for use in this type of surface covering system is also proposed and claimed. In this case, the surface covering system can be shaped according to one or more of the above-described embodiments. Accordingly, the above description can be referred to for possible details and embodiments of the covering module. The covering module includes at least one first sealing profile and/or at least one second sealing profile, the covering module being set up to be supplemented by at least one further covering module to form the surface covering system.

In addition, as claimed in the invention, a frame for use in a surface covering system as claimed in one or more of the above-described embodiments is proposed. Accordingly, here too, the above description can also be referred to for possible embodiments of the surface covering system or of the frame, in particular the aspects relating to a frame of a surface covering system of this type. The frame comprises at least one accommodating means for accommodating the covering material, in particular tile material. In addition, the frame comprises at least one first sealing profile and/or at least one second sealing profile, the first or the second sealing profile being set up to interlock during the laying process into a second sealing profile or a first sealing profile of a second frame in such a manner that a common seal is produced.

All in all, the surface covering system, the covering module and the frame as claimed in the invention comprise a plurality of advantages compared to known devices of this type. Thus, it is possible to create a surface covering system that can be laid rapidly, and can also be exchanged rapidly again where required, said surface covering system preferably also being able to be laid rapidly and simply without a tool. Nevertheless, good mechanical stability is ensured. In addition, seals can be achieved which, with regard to their sealing and permanence, are far superior compared to seals of comparable systems known in the prior art. Numerous advantages are also to be noted as esthetic, as, as represented above, substantially joint-free top surfaces can be produced on the common seal and these do not influence the esthetic impression or only influence it in an insignificant manner. In addition, visual effects can also be created such as, for example, transparent common seals or the like.

Further details and features are produced from the following description of the preferred exemplary embodiments in combination with the subclaims. In this case, the individual features represented in the exemplary embodiments can be realized individually or also in combination. Identical reference numerals in the individual figures in this case denote identical elements or functionally identical elements or elements that correspond to each other in their functions. The invention is not restricted to the exemplary embodiments represented.

DETAILED DESCRIPTION OF THE INVENTION

Figure 1:
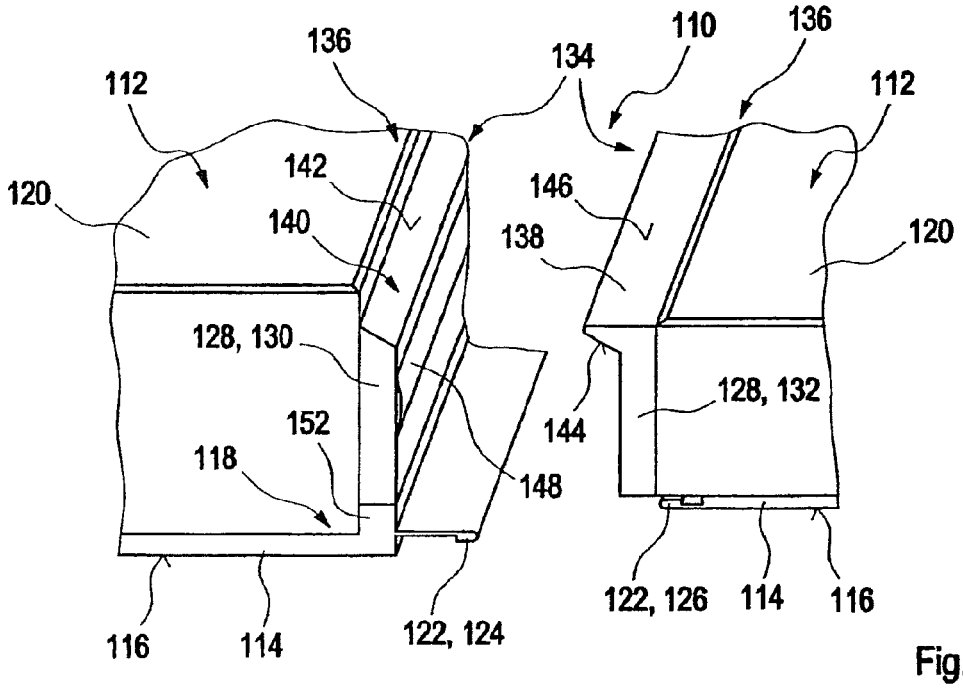
FIG. 1 shows a perspective section of a first exemplary embodiment of a surface covering system.

FIG. 1 shows a perspective representation of a first exemplary embodiment of a surface covering system 110 as claimed in the invention. In this case, cutouts of two covering modules 112 that interact in a complementary manner are represented not to scale and not to the correct scale one relative to the other. Said covering modules 112, when laid, are joined together, where applicable in common with further covering modules 112, to form the surface covering system 110.

The covering modules 112 include in each case a frame 114. Said frame 114 can be shaped, for example, as a plastics material frame and presents at least one supporting surface 116 for contact with the surface to be covered. The frame 114 can be shaped, for example, as a grid-shaped frame and in the exemplary embodiment shown comprises, for example, an indentation 118.

Covering materials 120 are inserted in each case into the indentation 118 of the frame 114. Said covering materials 120 are represented in the exemplary embodiment shown as rectangular panels, for example in the form of stone tiles, ceramic tiles, glass tiles or the like. Other materials are also possible, it being possible to refer to the above-described list of exemplary embodiments.

In addition, the frames 114 each comprise connecting elements 122. By means of said connecting elements 122, the covering modules 112 can be interconnected to form the surface covering system 110 such that the mechanical stability of the holding-together of the surface covering system 110 is increased. The connecting elements 122 in the exemplary embodiment represented are designed similarly to a click laminate system and comprise a male connecting element 124 and a female connecting element 126. The male connecting element 124 can engage in the female connecting element 126 during the laying process and can lock there by means of an expanded head. In this case, in FIG. 1 just one edge of the covering module 112 is provided with these kinds of connecting elements 122. As an alternative to this or in addition, however, further edges can also be provided with these types of connecting elements 122, for example the edges facing the observer in FIG. 1. Numerous covering modules 112 can be joined together in this way.

In addition, the covering modules 112 in the exemplary embodiment represented in FIG. 1, each comprise sealing profiles 128. Said sealing profiles 128 include a first sealing profile 130 realized on the left-hand covering module 112 in FIG. 1 and a second sealing profile 132 shown on the right-hand covering module 112 in the exemplary embodiment shown in FIG. 1. The first sealing profile 130 and the second sealing profile 132, in this case, work together in a complementary manner and, when the two covering modules 112 are interconnected, form a common seal 134 between the two abutting edges 136 facing each other of the two covering modules 112 represented in FIG. 1. It must also be pointed out again in this connection that in FIG. 1, just one of the abutting edges 136 of each covering module 112 is provided with a sealing profile 128 of this kind. Analogously to the connecting elements 122, however, other edges of the covering modules 112 can also be shaped in this manner to enable, once again, a level connection between several covering modules 112. For example, all four abutting edges 136 of a covering module 112 can be provided with sealing profiles 128, for example it also being possible to provide first and second sealing profiles 130, 132 together on a covering module 112. In particular, all four covering modules 112 can be realized identically or substantially identically, in particular with regard to the design of the frame 114 and of the sealing profile 128. The covering material 120, in this case, can vary optionally from covering module 112 to covering module 112.

In this case, the two sealing profiles 128 of the covering modules 112 interact, as described above, in a complementary manner. For this purpose, in the exemplary embodiment represented in FIG. 1, the second sealing profile 132 includes an overlap part 138, which closes off said second sealing profile 132 upwards, that is to say facing an observer. In a corresponding manner, the first sealing profile 130 includes an accommodating part 140 at its upper end. Whilst the accommodating part 140 is provided with an upwardly pointing, inclined first supporting surface 142, the overlap part 138 comprises a downwardly pointing, inclined second supporting surface 144. If the two covering modules 112 are joined together along their abutting edges 136, such that the common seal 134 is formed, the overlap part 138 then rests on the accommodating part 140, such that the second supporting surface 144 comes to rest on the first supporting surface 142. The two sealing profiles 128 consequently overlap. On its top side, the overlap part 138 comprises a top surface 146, which is shaped in the exemplary embodiment represented as a level top surface 146. If the two surface covering modules 112 are joined together along their abutting edges 136, said top surface 146 then extends in the exemplary embodiment represented substantially from the covering material 120 of the left-hand covering module 112 as far as the covering material 120 of the right-hand covering module 112. The top surface 146 is consequently a common, substantially joint-free top surface 146. This means that on the one hand the sealing effect is increased as the overlap between the sealing profiles 128 is now managed as claimed in the invention with a smaller number of joints. In addition, the common seal 134 is now no longer recognizable to an observer as a two-part seal, which improves the overall esthetic impression of the seal.

Figure 2:
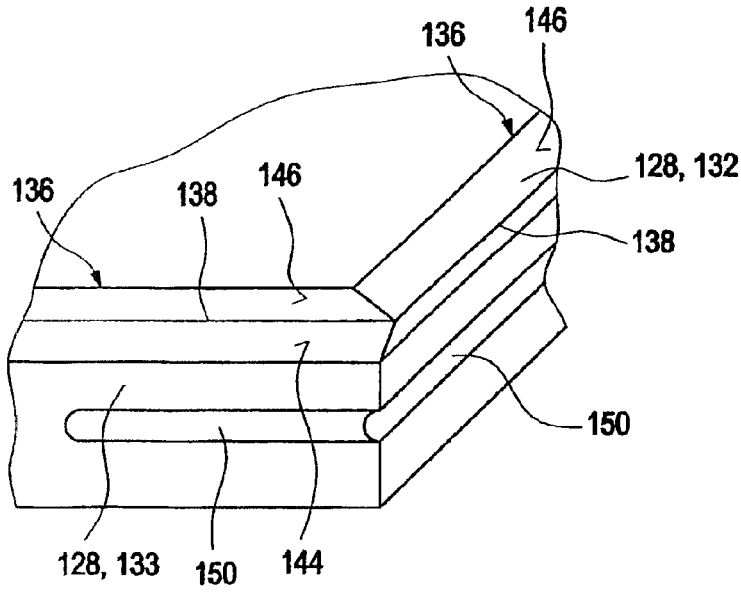
FIG. 2 shows a sealing profile which is insertable for example in the surface covering system according to FIG. 1.

In addition, an optional projection 148, which can additionally improve the sealing effect, can be seen in the exemplary embodiment in FIG. 1. Said projection 148 extends horizontally and parallel to the abutting edge 136 of the left-hand covering module 112 in FIG. 1. The projection 148 can be realized, for example, as a round projection and can press against the corresponding counter surface of the second sealing profile 132. However, as an alternative to this, said projection 148 can also engage in a corresponding indentation or groove 150 in the second sealing profile 132. Said groove 150 is shown in FIG. 2. FIG. 2 just shows the second sealing profile 132, which can be arranged in this exemplary embodiment along two adjoining abutting edges 136 of the covering module 112, for example abutting edges 136 that extend at right angles to each other. The remaining two abutting edges 136, which are not shown in FIG. 2, can be provided, for example, with a first sealing profile 130.

In the embodiment in FIG. 2, in combination with the projection 148 in the first sealing profile 130 in FIG. 1, the first sealing profile 130 is consequently shaped as a male sealing profile, whereas the second sealing profile 132 is shaped as a female sealing profile. The projection 148 engages sealingly into the groove 150. Other types of interlocking elements that interlock in each other can also be provided in the sealing profiles 130, 132. The sealing effect of the common seal 134 is strengthened in this way as said sealing effect is now no longer effected just by the overlap between overlap part 138 and accommodating part 140 and by pressing together the sealing profiles 130, 132, but additionally also by means of the engagement of the projection 148 in the groove 150.

The sealing profiles 128 can be composed of a plurality of different materials. Especially preferred in this case are flexible, elastic or at least plastically deformable materials. Especially preferred are silicone materials or foamed polyurethane. It is also possible to use transparent materials, which can be utilized for producing specific light effects.

The sealing profiles 128, in this case, can be connected in one piece to the frame 114 in FIG. 1. This can be achieved for example through multiple-component forming processes, such as, for example, multiple-component injection molding or multiple-component transfer molding.

Figure 3:
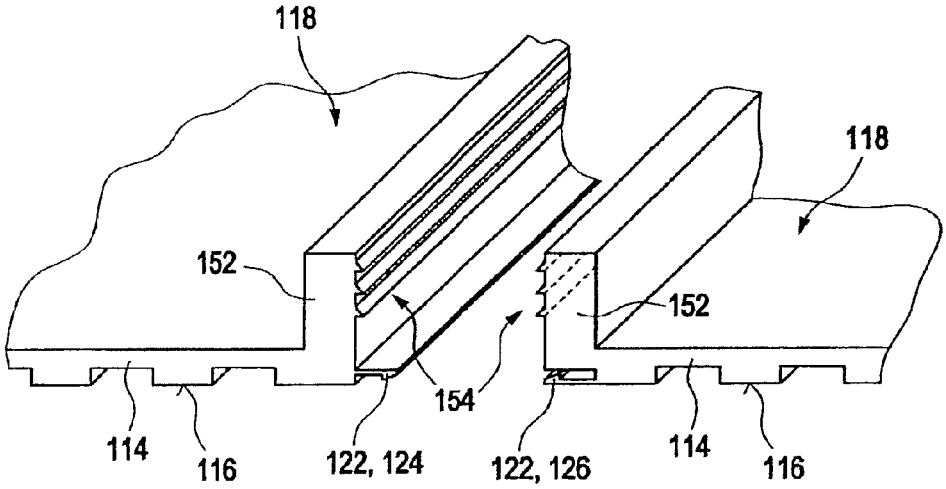
FIG. 3 shows an exemplary embodiment of a frame for a surface covering system.

As an alternative to this or in addition, the sealing profiles 128 can also be connected to the frames 114 in a non-positive or positive locking manner. An example of this type of non-positive or positive locking connecting method is pressing. In order to simplify pressing the sealing profiles 128 with the frames 114, the frames 114 can also comprise attachments 152, which make it easier to press the sealing profiles 128 with the frames 114. This is shown as an example in FIG. 3. In this case it can be seen that the attachments 152 represent circumferential, drawn-up edges that are represented in FIG. 3 only along the common abutting edges 136 of the subsequent covering modules 114. Supplementing said attachments 152 on the side facing the observer in FIG. 3, however, is also possible in principle and is even preferred. Said attachments 152 form the indentation 118 for accommodating the covering materials 120 that are not shown in FIG. 3.

As can be seen in FIG. 3, the attachments 152 in this exemplary embodiment comprise outwardly pointing barbs 154. In this exemplary embodiment three barbs 154 are provided. During pressing, said barbs 154 increase the holding-together between the sealing profiles 128 and the attachments 152. However, in principle other types of connecting elements that increase the holding-together are also possible.

Figure 4:
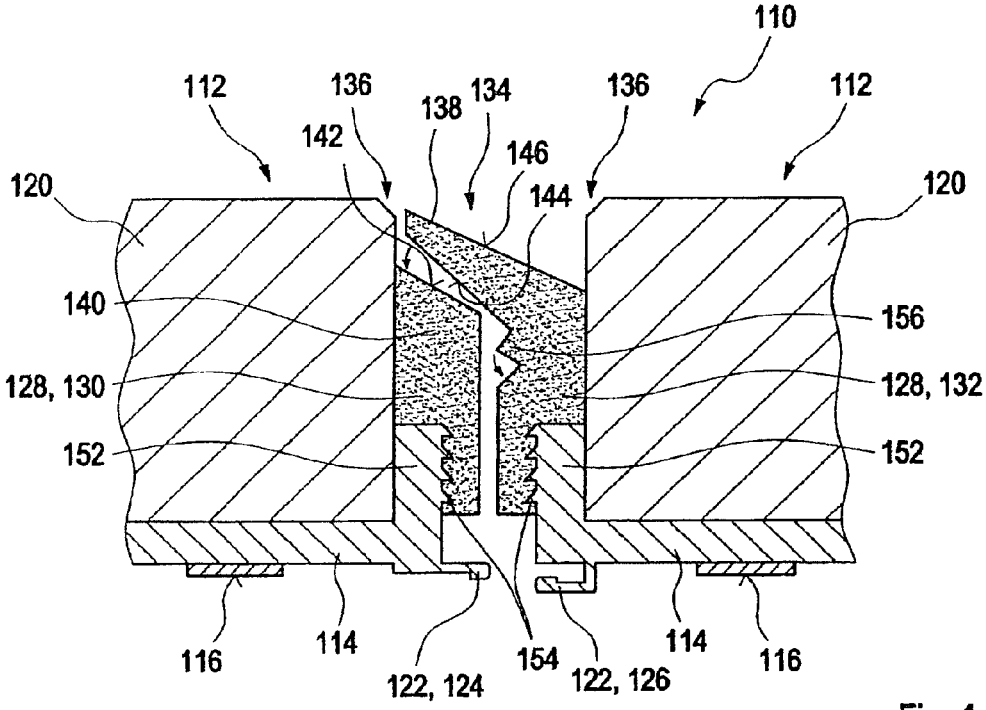
FIG. 4 shows a sectional representation of a second exemplary embodiment of a surface covering system that is an alternative to FIG. 1.

To ensure as strong a sealing effect as possible for the common seal 134, in principle pressing adjacent covering modules 112 together horizontally is sufficient. However, it is preferred when, in particular with overlapping parts of the sealing profiles 130, 132, a force is also exerted in opposition to said direction, that is to say a force that also presses the sealing profiles 130, 132 together perpendicular to the plane of the covering system 110. This can be effected in different ways. One exemplary embodiment of said design of the invention is shown in FIG. 4. The exemplary embodiment is basically similar to the exemplary embodiment shown in FIG. 1 such that the first sealing profile 130 comprises an accommodating part 140 with a first supporting surface 142, and the second sealing profile 132 comprises an overlap part 138 with a second supporting surface 144.

In the case of the exemplified embodiment shown in FIG. 4, the supporting surfaces 142, 144 can be shaped, for example, so as to be non-parallel to each other. The second sealing profile 132, in said exemplary embodiment, includes a lifting element 156 in the form of a prism-shaped projection, which points to the first sealing profile 130. If the two covering modules 112 are joined together along their abutment edges 136 and for example are held by the connecting elements 122, the first sealing profile 130 then presses onto said lifting element 156. As indicated by the arrows in FIG. 4, this causes the overlap part 138 in FIG. 4 to be bent downwards such that the second supporting surface 144 is pressed onto the first supporting surface 142. This increases the sealing effect in a considerable manner.

A further possibility for improving the sealing effect of the common seal 134 is to shape the overlap part 138 or the second supporting surface 144 right from the start at a flatter angle to the plane of the surface covering system 110 than the first supporting surface 142. This is shown in FIG. 6, which is explained in more detail below in conjunction with FIG. 5. As illustrated by arrows in FIG. 6, which does not show the sealing profile 128 facing the observer, the overlap part 138 is then bent upwards by the accommodating part 140 when the covering modules 112 are pushed together. As soon as the second supporting surface 144 rests on the first supporting surface 142, the overlap part 138 is then impinged upon with an initial stress towards the accommodating part 140 which means that the overlap part 138 is also pressed against the accommodating part 140 to improve the sealing effect. This embodiment can be implemented as an alternative to or in addition to the lifting element 156 in FIG. 4.

After the joining together process, a common seal 134 is also formed in the exemplary embodiment in FIG. 6 with a substantially joint-free top surface 146 between the covering materials 120 of joined covering modules 112. In this case, FIG. 6 does not show the covering material 120 of the right-hand covering module 112.

In embodiments to date, the connection between adjacent covering modules 112 in the surface covering system 110 has always been maintained substantially by means of the connecting elements 122. However, in principle, absolutely no mechanical connection of this kind would be necessary, but rather the mechanical stability of the surface covering system 110 could be ensured, for example, by the individual covering modules 112 being fixed on the surface to be covered. It would also be possible theoretically to bond adjacent covering modules 112.

Figure 5:
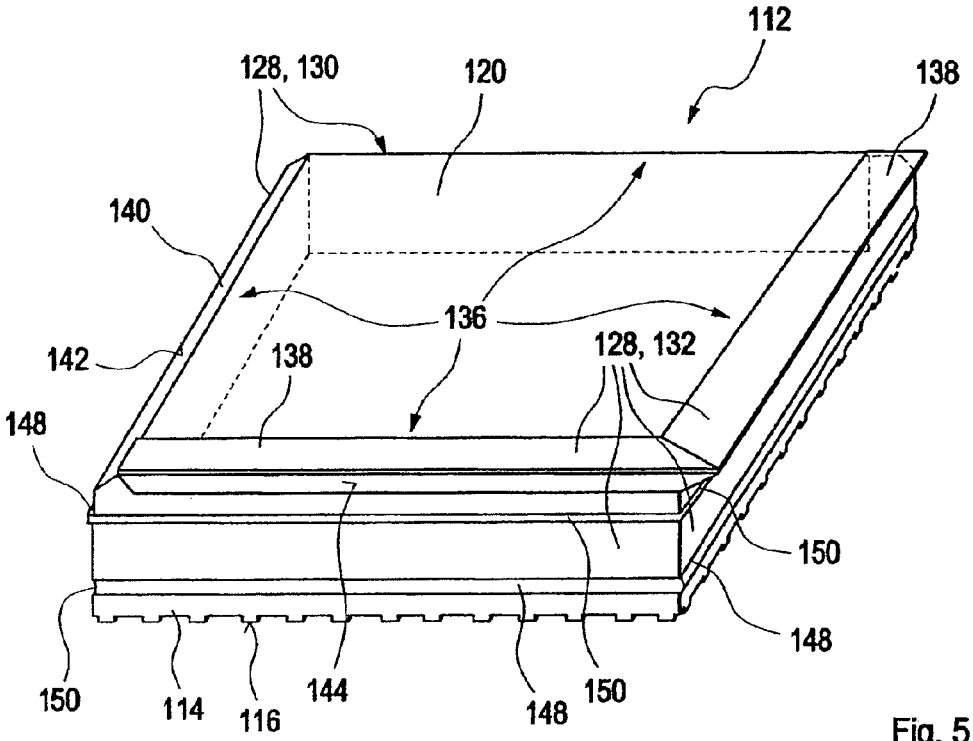
FIG. 5 shows a modification of the surface covering system in FIG. 1 with a male and a female sealing profile.
Figure 6:
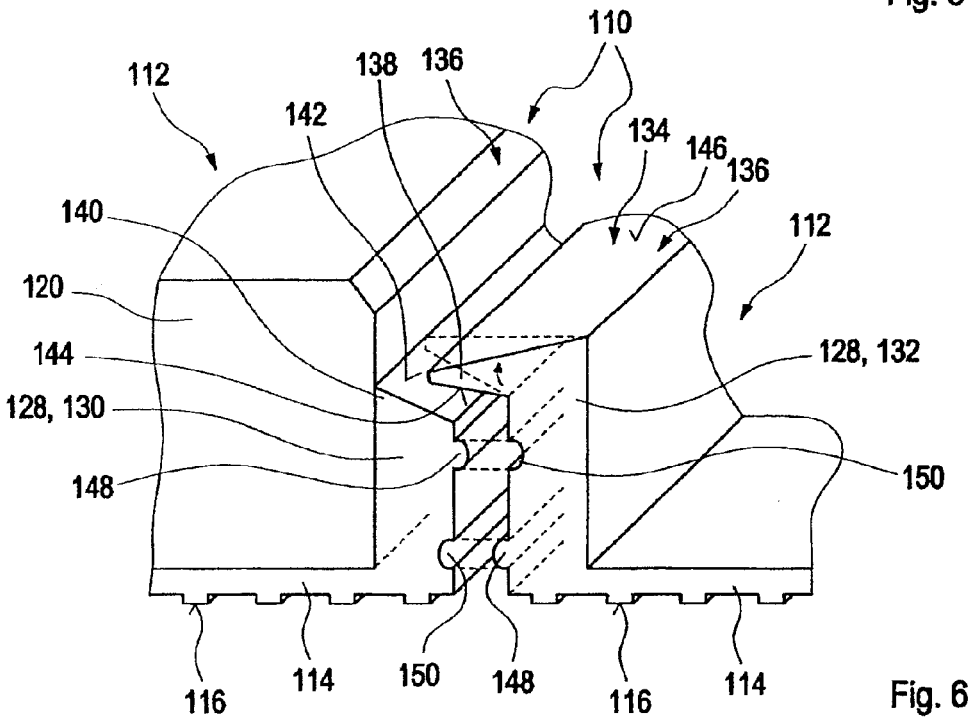
FIG. 6 shows a sectional representation of a modification of the surface covering system shown in FIG. 5.

FIGS. 5 and 6 show a further alternative where the connection between adjacent covering modules 112 is not effected by connecting elements 122 secured to the frame 114, but rather by a design of the first or second sealing profiles 130, 132 as male or female sealing profiles. In this case, FIG. 5 shows a single covering module 112, and FIG. 6 shows the connection between said covering module 112 and an adjacent covering module 112.

In this case it can be seen that the covering modules 112 in FIG. 5 comprise first sealing profiles 130 once again on each of two adjacent abutting edges 136 that extend perpendicular to each other, whereas on the two opposite, abutting edges 136 that are also adjacent and extend perpendicular to each other, second sealing profiles 132 are provided. This means that all covering modules 112 can be shaped in a substantially identical manner and can be assembled together to form a surface covering system 110.

In this case it can be seen that the first sealing profiles 130 and the second sealing profiles 132 each have a projection 148 and a groove 150. Said projections 148 or grooves 150 correspond to each other in each case. This means that in the exemplary embodiment shown, the projections 148 are arranged at the bottom in the second sealing profile 132 and correspond with a groove 150 also arranged at the bottom in the first sealing profiles 130. In an analogous manner, grooves 150 that correspond to projections 148 in the first sealing profiles 130 and extend parallel to the abutting edges 136 are arranged at the top in the second sealing profiles 132.

FIG. 6 shows the interaction between said projections 148 and grooves 150. Each of the sealing profiles 128 is consequently shaped both as a male sealing profile and as a female sealing profile to interact with a corresponding opposite sealing profile. The projections 148, in this case, are preferably shaped in such a manner that they lock in the grooves 150 in undercuts in said grooves 150 such that as soon as the projections 148 are locked in the grooves 150, a mechanical holding function is ensured.

Said mechanical holding function effected through the projections 148 or grooves 150 can be used as an alternative to or in addition to the connecting elements 122 connected to the frame 114. This means that the strength of the connection between adjacent covering modules 112 is increased along the abutting edges 136, and the sealing effect of the common seal 134 is improved.

Figure 7:
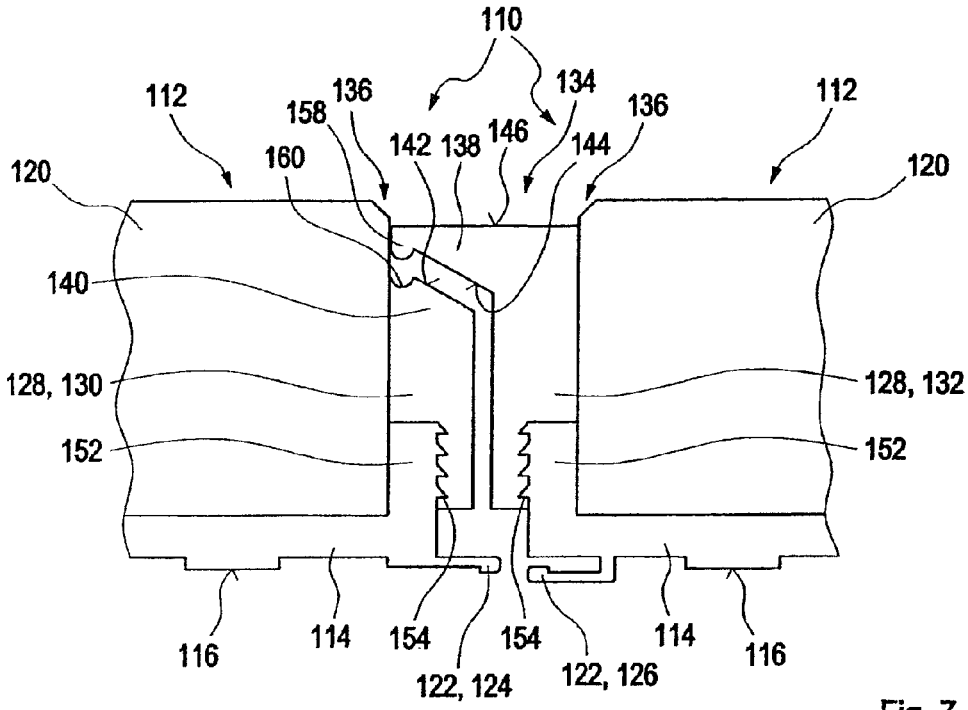
FIG. 7 shows a sectional representation of a further modification of the surface covering system according to FIG. 1.
Figure 8:
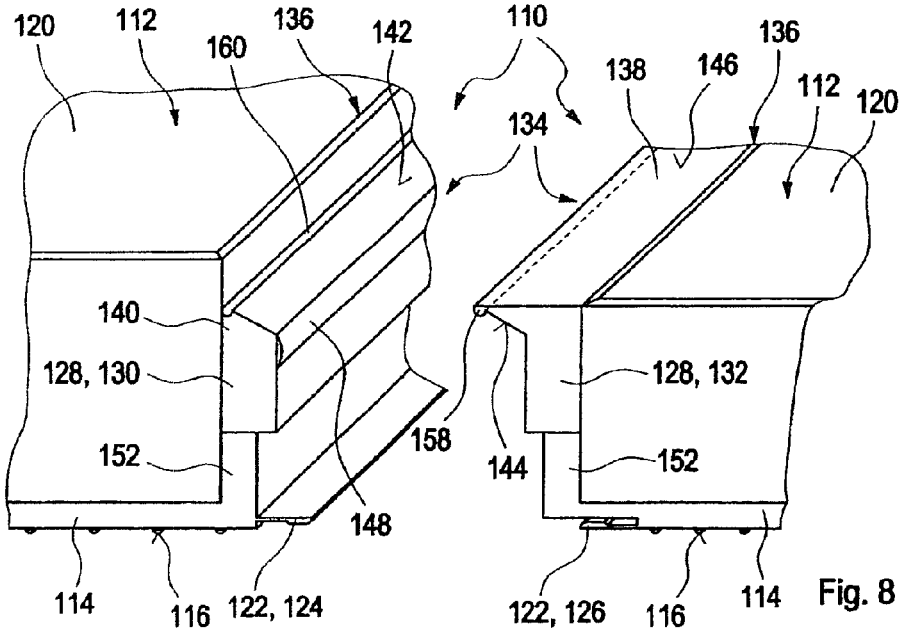
FIG. 8 shows a perspective representation of a modification of the surface covering system according to FIG. 7.
Figure 9:
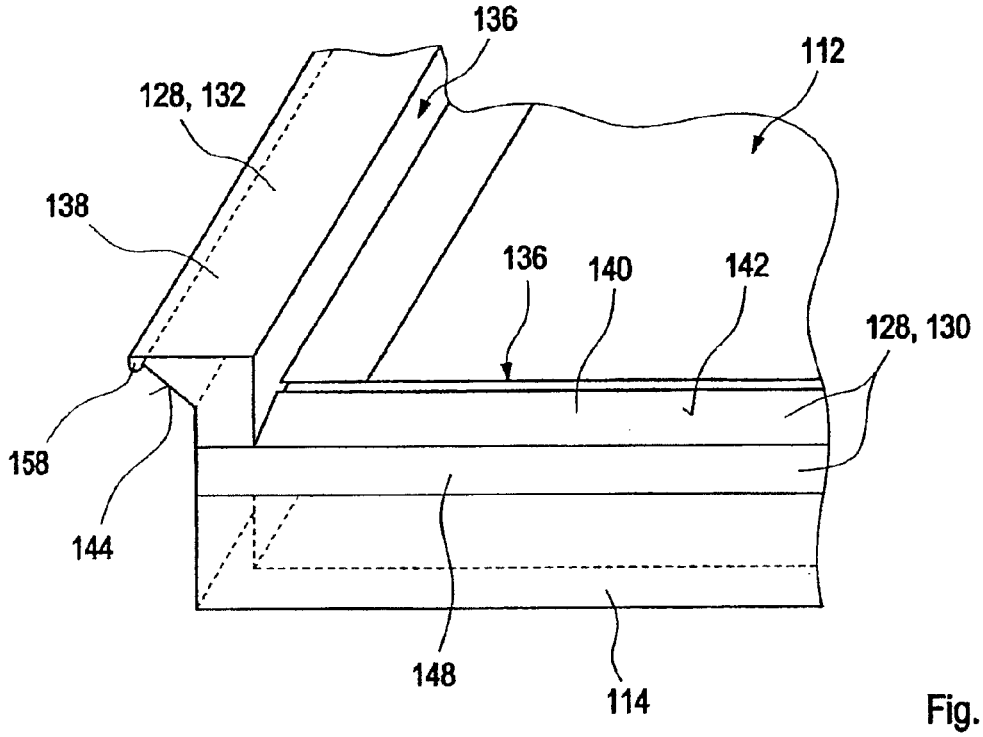
FIG. 9 shows a first corner of a covering module of a surface covering system according to FIG. 8.

A modified exemplary embodiment of the exemplary embodiment in FIGS. 1 and 2 can be seen in FIGS. 7 to 9. In this case, FIG. 7 shows a sectional representation through the surface covering system 110, and FIGS. 8 to 10 show different perspective views of details of said surface covering system 110 or of individual covering modules 112.

Once again the covering modules 112 comprise in each case first sealing profiles 130 and second sealing profiles 132 on adjoining abutting edges 136. FIG. 9, for example, shows a perspective representation that shows the transition from one abutting edge 136 with a first sealing profile 130 to an abutting edge 136 with a second sealing profile 132. FIG. 10 shows a transition between two abutting edges 136 with first sealing profiles 130.

For the embodiment in FIGS. 7 to 10, reference can be made extensively to the above figures. As an option, the covering modules 112 once again comprise connecting elements 122, as shown in FIGS. 7 and 8, for example once again in accordance with the click laminate principle. In addition, FIG. 7 shows that once again, as an option, the sealing profiles 128 can be pressed with the frame 114, which once again can be optimized, for example, by means of attachments 152 with barbs 154. However, as an alternative to this, in principle the sealing profiles 128 can be designed in one piece with the frame 114 or the sealing profiles 128 can be directly connected (for example bonded) to the covering materials 120 or to other components of the covering modules 112.

Figure 10:
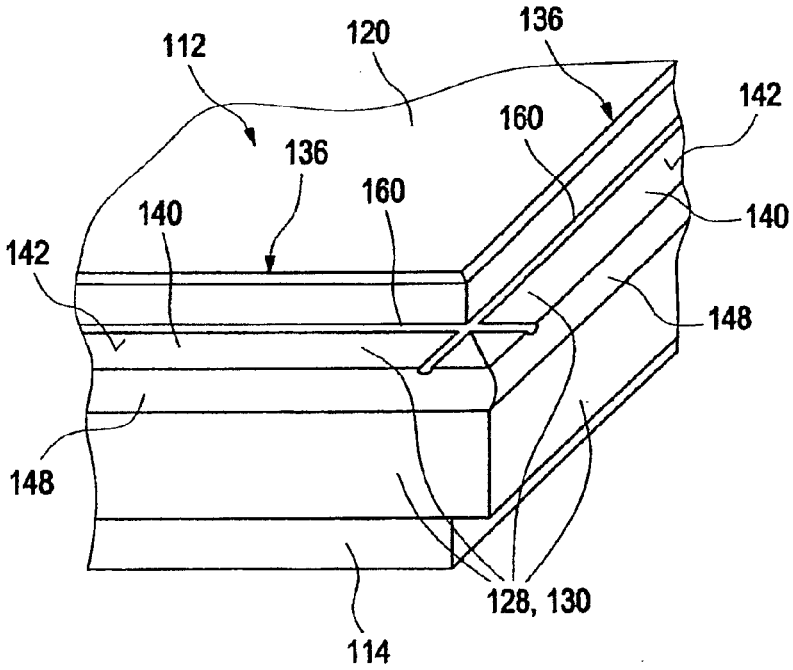
FIG. 10 shows a second corner of a covering module of the surface covering system according to FIG. 8.

As also indicated in FIG. 8, FIG. 9 and FIG. 10, the sealing profiles 128 can also be shaped in twos as male/female sealing profile pairs. This is indicated once again by the projections 148 and corresponding grooves 150 in corresponding sealing profiles 130, 132. Reference can be made to the above description for the advantages and details.

Once again, in the exemplary embodiment in FIGS. 7 to 10, the second sealing profile 132 comprises an overlap part 138 with a second supporting surface 144. Said overlap part 138 once again comes to rest on a corresponding accommodating part 140 with a first supporting surface 142 of the first sealing profile 130, as indicated in FIG. 7. The above description, for example, of the preceding exemplary embodiments can be referred to extensively in this respect.

In addition, however, the overlap part 138, at its end facing the adjacent covering module 112, comprises a projection 158 pointing downward, that is to say towards the surface to be covered. Said projection engages in a corresponding groove 160, which is realized in the first supporting surface 142 on its end facing the covering material 120 and points upward, that is to say away from the surface to be covered. If the covering modules 112 are laid, the projection 158 locks into the groove 160. Other types of interlocking elements, where a part of the overlap part 138 locks into another part of the accommodating part 140, can also be provided. If the overlap part 138 is impinged upon downwards by an initial stress, such as for example has been described above by way of FIG. 6, said locking of the projection 158 into the groove 160 is favored even more by the resetting forces of the overlap part 138. This means that the holding-together of the common seal 134 in the exemplary embodiment in FIGS. 7 to 10 is further strengthened and the sealing effect is increased.

FIG. 10 shows how the grooves 160 of first sealing profiles 130 terminate in a crosswise manner at adjoining abutting edges 136. However, the grooves 160 can also be realized in a purely sectional manner along the abutting edges 136, just as the sealing profiles 128 can also be realized in a purely sectional manner.

Figure 11:
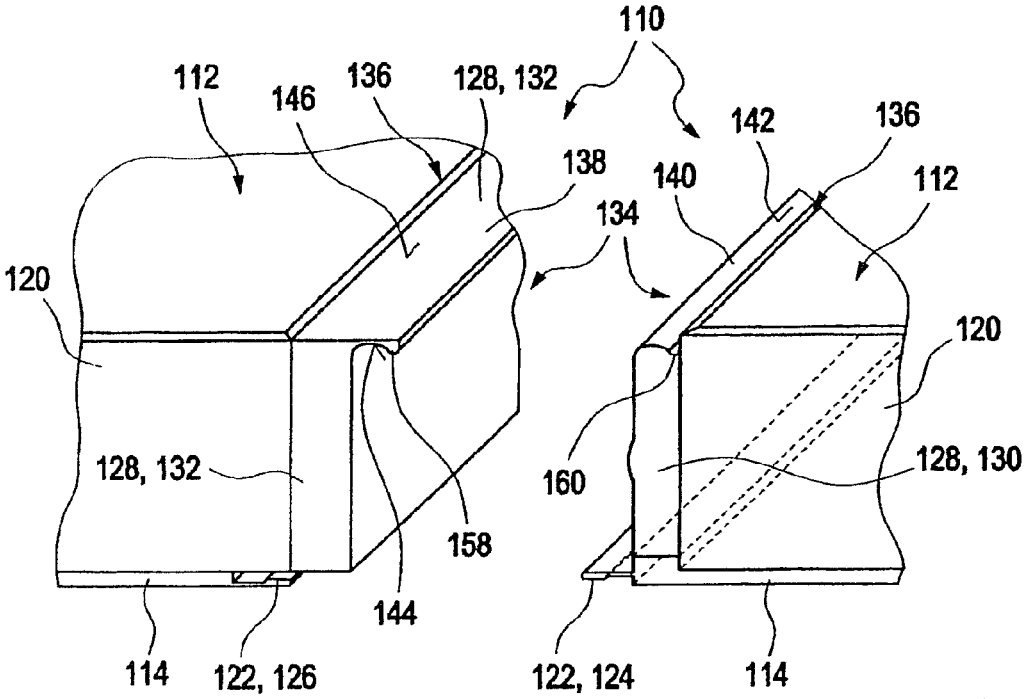
FIG. 11 shows an exemplary embodiment of a surface covering system as an alternative to the one in FIGS. 7 to 10.
Figure 12:
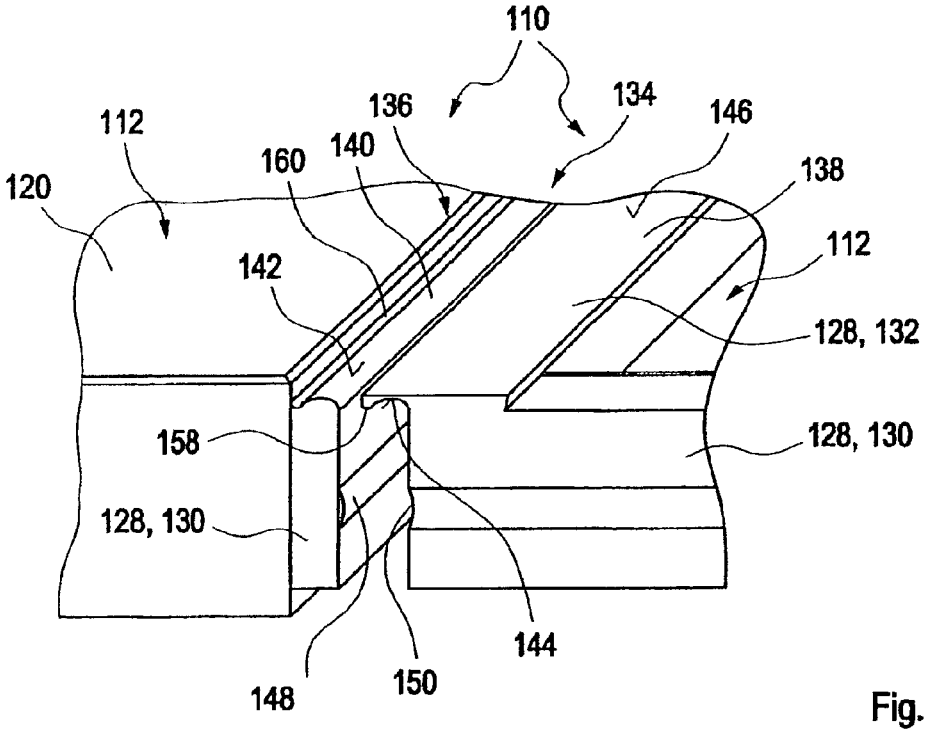
FIG. 12 shows a modification of the surface covering system according to FIG. 11.

In the exemplary embodiments represented up to now, the first supporting surface 142 and the second supporting surface 144 are each represented as level surfaces. However, this is not necessarily required. Thus, FIGS. 11 and 12 show exemplary embodiments that deviate slightly from each other where said surfaces 142, 144 are not shaped as level surfaces but rather as curved surfaces. The two exemplary embodiments differ substantially from each other in that in the exemplary embodiment in FIG. 12, once again projections 148 and grooves 150 are provided, corresponding with each other analogously to the exemplary embodiments already described above. Once again they are able to interlock and strengthen the sealing effect. Otherwise, the above description can be referred to in an extensive manner.

Apart from the fact that in the exemplary embodiments in FIG. 11 and FIG. 12 each of the surfaces 142, 144 are curved, said exemplary embodiments correspond extensively to the above exemplary embodiments with the overlap part 138 and the accommodating part 140. In this respect, reference can also be made extensively in this connection to the above description. The curved design of the surfaces 142, 144 can further improve the engagement of the overlap part 138 or of the projection 158 in the groove 160 and thus strengthen the holding-together of the sealing profiles 128 in the common seal 134 and increase the sealing effect. Otherwise, reference can be made extensively to the above description for further possible details and further possible designs.

Figure 13:
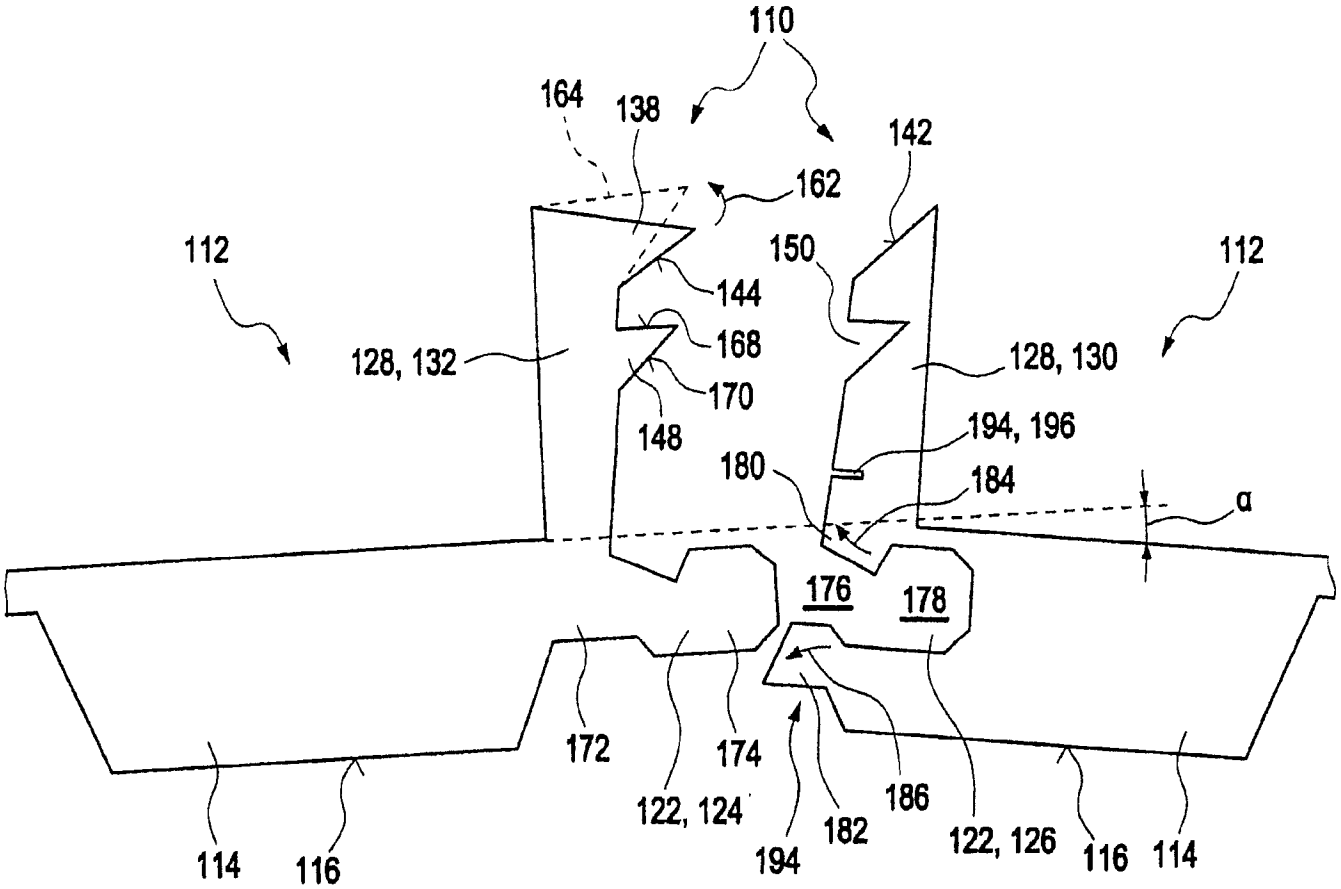
FIGS. 13 and 14 show modifications of the surface covering system according to FIG. 6.
Figure 14:
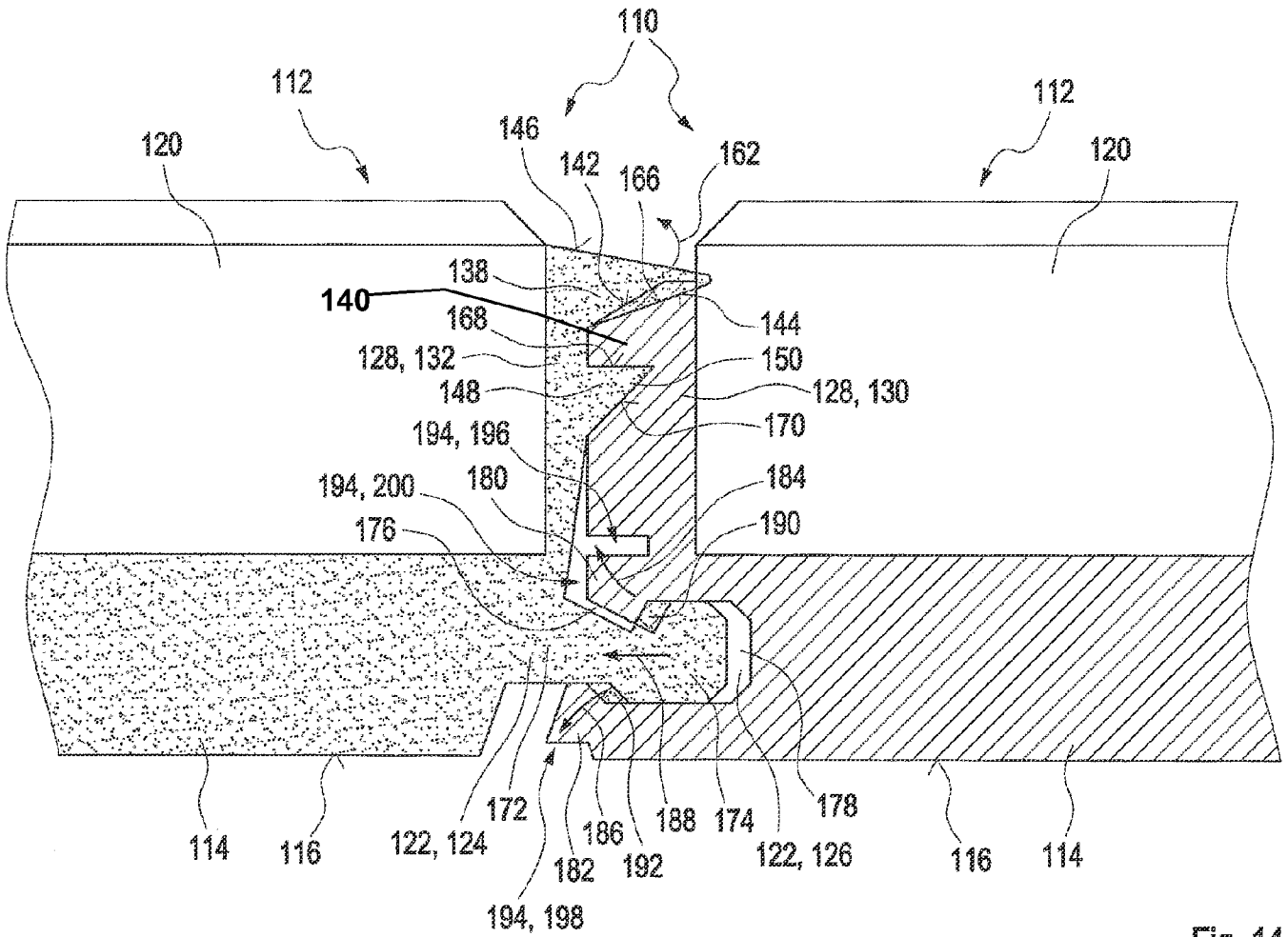

FIGS. 13 and 14 show a further exemplary embodiment of a surface covering system 110. In this case, FIG. 13 shows the two frames 114 of the surface covering modules 112 to be interconnected, whereas FIG. 14 shows the surface covering system 110 in the disassembled state.

Once again, the covering modules 112 comprise sealing profiles 128 for the connection, namely a first sealing profile 130 and a second sealing profile 132. Said sealing profiles 128 exhibit similarities to the sealing profiles 128 in FIG. 6. Thus, the first sealing profile 130 once again includes a first supporting surface 142, and the second sealing profile 132 includes an overlap part 138, which has a second supporting surface 144 that points downwards. In this case, the angles of the second supporting surface 144 and of the first supporting surface 142 do not correspond with each other. As indicated in FIG. 13 by the arrow 162 (bending) and the dotted line 164 (position in the laid state), during laying the overlap part 138 is bent upwards by the first supporting surface 142, the second supporting surface 144 being pressed more intensively onto the first supporting surface 142 by the resetting forces. The overlap region 166 indicates this in FIG. 14, where the covering modules 112 are represented in the laid state and where the bending 162 is not yet taken into account. The representation in FIG. 14 is not realistic in this respect. The first sealing profile 130, in this case, is shown in a hatched manner in the representation in FIG. 14, whereas the second sealing profile 132 is shown by the dots.

In addition, in the exemplary embodiment represented, the second sealing profile 132 once again comprises, as an option, a projection 148 and the first sealing profile 130 a corresponding groove 150 or vice versa. However, in contrast to the exemplary embodiment in FIG. 6, in this case in the exemplary embodiment in FIGS. 13 and 14, the projection 148 and the corresponding groove 150 are not round, but rather are wedge-shaped, with a top side 168 that points substantially perpendicularly upwards and an inclination 170 of the projection 148, or rather with corresponding surfaces in the groove 150. By creating a longer path for the moisture to have to cover when penetrating from above, said wedge form additionally strengthens the interlocking of the two sealing profiles 128 such that the sealing effect is further increased.

In addition, the sealing profiles 128 once again include connecting elements 122, in this case once again a male connecting element 124 and a corresponding female connecting element 126. The connecting elements 122 are basically shaped in a similar manner to the connecting elements 122 in the preceding exemplary embodiments, for example the exemplary embodiments in FIGS. 7 and 8. Thus the male connecting element 124 comprises a body 172 and at its end a thickening 174. The female connecting element 126 correspondingly comprises a channel 176 and a cavity 178. The wall segments 180, 182 around the channel 176 are shaped so as to be slightly flexible, as preferably is the entire sealing profile 128, such that they can deform when the thickening 174 is inserted. The deformations are shown in the figures by the arrows 184 and 186.

In addition, FIG. 13 indicates a state in which the two covering modules 112 are arranged in a non-level orientation with respect to each other. A state such as this can be created during the laying process or by floor unevenness. The non-level state, in this case, is characterized by the angle $\alpha$ which in this case is greater than 0°.

In this state, preferably at an angle of between 0° and 5°, in a preferred embodiment the thickening 174 can be inserted force-free into the cavity 178. The sealing profiles 130, 132 are correspondingly dimensioned.

If the covering modules 112 are then moved in contrast into a level orientation, which is indicated in FIG. 14, i.e. towards an angle $\alpha$ of at least approximately 0°, the thickening 174 is pulled out of the cavity 178 and is pressed against the wall segments 180, 182. The movement is denoted in FIG. 14 by the reference numeral 188. Once again in this case a non-realistic, non-deformed representation is selected in FIG. 14, in which overlapping regions 190, 192 are marked in each case in the region of the top wall segment 180 and the bottom wall segment 182. The wall segments 180, 182 would realistically move outwards, once again in the direction of the deformations 184 or 186. The sealing profiles 130, 132 preferably comprise one or more relief spaces 194 to accommodate said deformations 184, 186. A first relief space 194 is realized as relief gap 196 and is arranged above the top wall segment 180. A second relief space 194 is realized as free space 198 below the bottom wall segment 182. In both cases, said relief spaces 194 can absorb deformations 184, 186 of one or both of the sealing profiles 130, 132 without thereby pressing said sealing profiles 130, 132 apart, which would impair the sealing effect or the covering modules 112 would lift from the floor. In addition a further free space 200 is provided between the first sealing profile 130 and the second sealing profile 132, said further free space also working as relief space 194 and not, however, influencing the sealing effect.

As in the non-laid state, the supporting surfaces 142, 144 preferably form an angle of at least 5° with respect to each other, the covering modules 112 can form an angle of preferably up to 5° or greater with respect to each other in the laid state also without the sealing effect being interrupted by the overlap part 138 and the corresponding first supporting surface 142. Up to said angle, which can be produced, for example, by floor unevenness, the overlap part 138 is always deformed in the joining process and pressed against the first supporting surface 142 by a resetting force. The relief spaces 194 can absorb deformations 184, 186 of this type when the covering modules 112 are tilted relative to each other without thereby interrupting the sealing effect.

In addition, FIGS. 13 and 14 show a preferred embodiment of the surface covering modules 112, where the sealing profiles 128 can be shaped in one piece with the frame 114. For example, for the sealing profiles 128 and the frames 114, it is possible to use plastics materials, which are both deformable, correspondingly promote the sealing effect and also have the corresponding mechanical carrying capacity as is required for the frames 114. For example, the frames 114 can be molded with the sealing profiles 128 at the same time in one and the same mold, for example by means of an injection process and/or a casting process. Corresponding molds can be used for this purpose.

LIST OF REFERENCES

110 Surface covering system
112 Covering module
114 Frame
116 Supporting surface for contact with the surface to be covered
118 Indentation
120 Covering material
122 Connecting elements
124 Male connecting element
126 Female connecting element
128 Sealing profile
130 First sealing profile
132 Second sealing profile
134 Common seal
136 Abutting edges
138 Overlap part
140 Accommodating part
142 First supporting surface
144 Second supporting surface
146 Top surface
148 Projection
150 Groove
152 Attachment
154 Barb
156 Lifting element
158 Projection
160 Groove
162 Bend
164 Position in laid state
166 Overlap region
168 Top side
170 Inclination
172 Body
174 Thickening
176 Channel
178 Cavity
180 Top wall segment
182 Bottom wall segment
184 Deformation
186 Deformation
188 Movement
190 Overlap region
192 Overlap region
194 Relief space
196 Relief space
198 Free space
200 Free space

The invention claimed is:

1. A surface covering system for covering surfaces with a covering material, the surface covering system comprising:
at least a first covering module and a second covering module,
wherein the first and second covering modules can be laid on the surface so as to adjoin each other,
wherein each covering module comprises
a frame equipped for resting against the surface to be covered,
a panel of a covering material accommodated in the frame, the panel having a top surface, a bottom surface resting against the frame, and circumferential panel edges, and
an elastically deformable sealing profile arranged peripherally of the panel edges and surrounding the panel along the edges,
wherein the sealing profile is one-piece with the frame or is connected to the frame;
wherein the sealing profile of the first covering module is shaped so as to interlock with the sealing profile of the second covering module when the first and second covering modules are positioned relative to one another, and to form a common seal, and
wherein the sealing profile of the second covering module comprises an overlap part overlapping the sealing profile of the first covering module and extending to the panel of the first covering module to form a seamless common top surface between the top surfaces of the panels of the first and second covering modules.

2. The surface covering system as claimed in claim 1, wherein one of the two sealing profiles is shaped completely or in part as a male sealing profile and in that the other of the two sealing profiles is shaped completely or in part as a female sealing profile.

3. The surface covering system as claimed in claim 1, wherein the sealing profiles are each realized in one piece with the frame.

4. The surface covering system as claimed in claim 3, wherein the sealing profiles and the frame are produced completely or in part from a plastics material.

5. The surface covering system as claimed in claim 1, wherein the frames of the covering modules, each comprise mechanical connecting elements, in that the mechanical connecting elements are set up so as to enter into a mechanical connection when the covering modules are placed.

6. The surface covering system as claimed in claim 5, wherein the mechanical connection is shaped so as to allow joining two covering modules together in a non-level relative orientation of the covering modules without substantial deformation of the sealing profiles and so as to cause substantial mechanical deformation of the sealing profile when the covering modules are brought together in a level relative orientation.

7. The surface covering system as claimed in claim 5, wherein at least one of the connecting elements and the sealing profiles comprise at least one relief space, wherein the relief space is shaped so as to absorb any deformation occurring when two covering modules are joined together.

8. The surface covering system as claimed in claim 1, wherein the sealing profiles comprise at least one of the following materials: a foamed material, an elastomer material, a plastically deformable material, an elastically deformable material, a material that is at least partially transparent to visible light.

9. The surface covering system as claimed in claim 1, wherein each covering module comprises in each case at least one first sealing profile.

10. The surface covering system as claimed in claim 9, wherein the first sealing profiles are arranged at adjoining abutting edges and the second sealing profiles are arranged at adjoining abutting edges.

11. The surface covering system as claimed in claim 1, wherein at least the sealing profile of the first covering module comprises an accommodating part with a first supporting surface, wherein the overlap part comprises a second supporting surface, wherein in the positioned state the overlap part at least partially overlaps the accommodating part and the second supporting surface rests at least partially on the first supporting surface.

12. The surface covering system as claimed in claim 11, wherein the overlap part is capable of being pressed down against the accommodating part during the positioning process.

13. The surface covering system as claimed in claim 11, wherein the overlap part comprises a projection, the accommodating part comprises a groove, and the projection is capable of interlocking in the groove.

14. The surface covering system as claimed in claim 11, wherein at least one of the first supporting surface and/or the second supporting surface is shaped in each case in one of the following ways: as inclined supporting surfaces; as rounded supporting surfaces.

15. The surface covering system as claimed in claim 1, wherein at least one of the sealing profiles comprises a male interlocking element, at least one other sealing profile comprises a female interlocking element, the interlocking elements are capable of interlocking during the positioning process and of strengthening a sealing effect of the common seal.

16. The surface covering system as claimed in claim 1, wherein the covering modules are shaped substantially identically.

17. The covering module for use in a surface covering system as claimed in claim 1, said covering module including at least one of the first sealing profile and the second sealing profile, wherein the covering module is capable of being supplemented by at least one further covering module to form the surface covering system.

* * * * *